US010815946B1

(12) United States Patent
Kaczmar et al.

(10) Patent No.: US 10,815,946 B1
(45) Date of Patent: Oct. 27, 2020

(54) INTAKE MANIFOLD PLENUM AND RUNNER WITH CONDENSATE DRAINS

(71) Applicant: GM Global Technology Operations LLC, Detroit, MI (US)

(72) Inventors: Michael Kaczmar, Farmington Hills, MI (US); Amanda Keech, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/448,417

(22) Filed: Jun. 21, 2019

(51) Int. Cl.

| | |
|---|---|
| ***F02M 35/10*** | (2006.01) |
| ***F02M 35/08*** | (2006.01) |
| ***F02B 29/04*** | (2006.01) |
| ***F02M 35/104*** | (2006.01) |
| ***F02M 35/16*** | (2006.01) |

(52) U.S. Cl.
CPC ..... *F02M 35/104* (2013.01); *F02B 29/0468* (2013.01); *F02M 35/088* (2013.01); *F02M 35/10209* (2013.01); *F02M 35/16* (2013.01)

(58) Field of Classification Search
CPC ..... F02M 35/104; F02M 35/10209; F02M 35/16; F02M 35/088; F02B 29/0468
See application file for complete search history.

(56) References Cited

U.S. PATENT DOCUMENTS

2016/0245153 A1* 8/2016 Hayman ..... F02B 29/0468

* cited by examiner

*Primary Examiner* — Jacob M Amick

(57) ABSTRACT

An intake manifold of an automobile vehicle includes a manifold body connected to a cylinder head. A runner is in communication with the cylinder head. A plenum is in communication with the runner. An inner dividing wall is positioned between and partially separates the runner and the plenum while allowing communication between the plenum and the runner over a dividing wall end of the inner dividing wall. An orifice opening extends through the inner dividing wall providing a drain path from the plenum to the runner. The orifice drains a fluid collecting in the plenum to the runner.

16 Claims, 5 Drawing Sheets

72

| 180mm INTAKE RUNNER LENGTH | |
|---|---|
| DRAIN DIAMETER mm | RANGE |
| 0 | 0.341917 |
| 1 | 0.342309 |
| 2 | 0.343116 |
| 3 | 0.3488 |
| 4 | 0.355617 |
| 5 | 0.370822 |
| 6 | 0.393132 |
| 7 | 0.420326 |
| 8 | 0.451208 |
| 9 | 0.485397 |
| 10 | 0.519881 |

74 76

INTAKE MANIFOLD PLENUM AND RUNNER WITH CONDENSATE DRAINS

INTRODUCTION

The present disclosure relates to automobile vehicle engine intake manifolds and manifold geometry to promote condensate drain.

A long-runner intake manifold used for in-line engines presents packaging challenges. Runner length may be driven by mitigation of flow reversion from one intake port to an adjacent intake port, or resonant tuning of induction pulses in a given intake runner. Known intake manifold optimization often requires the runners to be rolled or contoured to avoid excessive packaging space. This rolling or contouring often creates cavities in the assembly that may create low elevation points which accumulate moisture or pooled oil from crankcase ventilation systems, particularly following engine shutdown and cooling.

Accumulated moisture negatively impacts subsequent engine startup and performance as the engine heat for vaporizing the moisture is not yet available during startup. A sudden vehicle performance demand event could cause the pooled moisture to drain into a single intake port, causing an engine misfire, or potentially damaging the engine from a large change in effective compression volume, known as hydrolock.

Thus, while current engine intake manifolds achieve their intended purpose, there is a need for a new and improved intake manifold of an automobile vehicle.

SUMMARY

According to several aspects, an intake manifold of an automobile vehicle includes a manifold body connected to a cylinder head. A runner within the manifold body is in communication with the cylinder head. A plenum within the manifold body is in communication with the runner. An orifice opens the plenum to the runner, the orifice defining a drain path to drain a fluid in the plenum to the runner.

In another aspect of the present disclosure, an inner dividing wall positioned between and partially separating the runner and the plenum while allowing communication between the plenum and the runner over the inner dividing wall.

In another aspect of the present disclosure, the plenum is rolled so that a first wall of the plenum is positioned on a cylinder head facing side of the inner dividing wall. A lowest point of the plenum is located on the cylinder head facing side of the inner dividing wall.

In another aspect of the present disclosure, the orifice is created in the inner dividing wall.

In another aspect of the present disclosure, a cylinder head intake port has a fixed port length from a cylinder intake port to a manifold connection. The runner is connected to the manifold connection with the runner in communication with the cylinder head intake port.

In another aspect of the present disclosure, the orifice is positioned at a first end of the runner located at the manifold connection.

In another aspect of the present disclosure, a diameter of the orifice ranges between zero mm up to 1 mm.

In another aspect of the present disclosure, the orifice is positioned at a mid-point of the runner between the manifold connection and the plenum.

In another aspect of the present disclosure, with the orifice positioned at the mid-point a diameter of the orifice ranges between zero mm up to 6 mm.

In another aspect of the present disclosure, the orifice is positioned at an end of the runner located at the plenum.

According to several aspects, an intake manifold of an automobile vehicle includes a manifold body connected to a cylinder head. A runner is in communication with the cylinder head. A plenum is in communication with the runner. An inner dividing wall is positioned between and partially separates the runner and the plenum while allowing communication between the plenum and the runner over a dividing wall end of the inner dividing wall. An orifice opening extends through the inner dividing wall providing a drain path from the plenum to the runner. The orifice drains a fluid collecting in the plenum to the runner.

In another aspect of the present disclosure, the orifice is positioned at a lowest point of a cavity defined by the plenum between the inner dividing wall and a wall of the plenum positioned closer to the cylinder head than the inner dividing wall.

In another aspect of the present disclosure, the orifice is further located at the lowest point of the cavity of the plenum.

In another aspect of the present disclosure, a manifold connection of the runner is provided, wherein the manifold connection is connected to a cylinder head intake port having a fixed port length from a cylinder intake port to the manifold connection.

In another aspect of the present disclosure, the runner is connected to the manifold connection with the runner in communication with the cylinder head intake port with a gravity drain path being provided from the orifice through the runner and into the cylinder head intake port.

In another aspect of the present disclosure, an optimum location of the orifice is at a mid-point of the runner between the manifold connection and the plenum.

In another aspect of the present disclosure, at the optimum location of the orifice, a size of the orifice ranges from zero mm up to approximately 6 mm.

According to several aspects, an intake manifold of an automobile vehicle includes a manifold body connected to a cylinder head. A runner defines a passageway in communication with the cylinder head, the passageway downwardly sloping from an entrance of the runner toward a manifold connection coupling the runner to the cylinder head. A plenum is in communication with the runner. The plenum has a cavity with a cavity lowest point. An inner dividing wall is positioned between and partially separating the runner and the plenum while allowing communication between the plenum and the runner over a dividing wall end of the inner dividing wall. An orifice extending through the inner dividing wall at the lowest point of the cavity provides a drain path from the plenum to the runner, the orifice draining a fluid collecting in the plenum to the runner.

In another aspect of the present disclosure, the plenum is rolled so that a first wall of the plenum is positioned on a cylinder head facing side of the inner dividing wall. The lowest point of the plenum is located on the cylinder head facing side of the inner dividing wall.

In another aspect of the present disclosure, an optimum location of the orifice is preselected at a mid-point of the runner between the manifold connection and the plenum.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
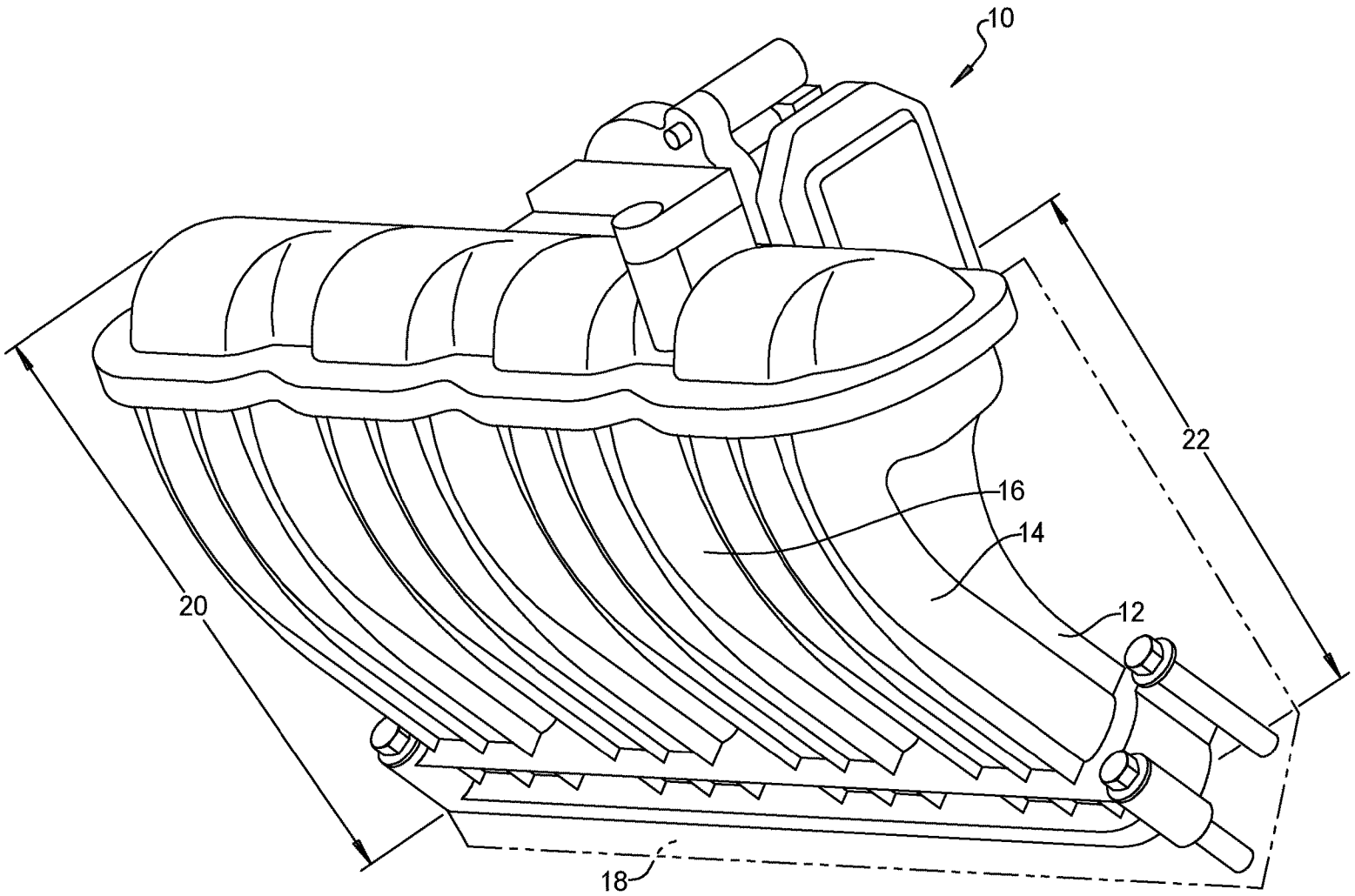
FIG. 1 PRIOR ART
FIG. 1 is a front right perspective view of a known automobile vehicle long-runner intake manifold.

Referring to FIG. 1, an intake manifold 10 of an automobile vehicle includes a manifold body 12, which may be manufactured as a casting of a metal material or molded from a polymeric material. The intake manifold 10 includes multiple runners such as a first runner 14 and a second runner 16 positioned in abutment to the first runner 14. The intake manifold runners deliver air mixed with a fuel to a cylinder (not shown) of a vehicle engine 18 only a portion of which is shown for clarity. A length 20 of the manifold body 12 is limited in available space, therefore a total length 22 of the intake manifold runners such as the first runner 14 plus a plenum 24 is limited to the length 20.

Referring to FIG. 2 and again to FIG. 1, a cylinder head intake port 26 has a fixed port length 28 from a cylinder intake port to a manifold connection 30. An exemplary intake manifold runner 32 (shown in phantom) and a plenum 34 (shown in phantom) which are designed to provide positive drainage of fluid in a drain direction 36 throughout a length of the intake manifold runner 32 would occupy a total runner-plenum width 38 measured from the manifold connection 30. Where packaging space for an intake manifold accommodating the runner-plenum width 38 is not available, according to several aspects a compact runner-plenum system 40 of the present disclosure reduces a runner-plenum width and therefore an intake manifold size compared to the runner-plenum width 38.

The runner-plenum system 40 includes multiple intake manifold runners individually having a plenum. As an example, an intake manifold runner 42 is connected to a plenum 44 with the plenum 44 opening into the intake manifold runner 42 and "rolling" the plenum 44 back toward the manifold connection 30 thereby forming an inner dividing wall 46 separating a portion of the intake manifold runner 42 and the plenum 44. A dividing wall end 46' of the inner dividing wall 46 is spaced below a high point 44' of the plenum 44 to allow communication of the intake manifold runner 42 with the plenum 44 over or above the dividing wall end 46'. By rolling the plenum 44 from its connection with the intake manifold runner 42 back toward the manifold connection 30, a wall 48 of the plenum 44 is positioned closer to a cylinder head 50 and to the manifold connection 30 than the inner dividing wall 46. As a consequence of rolling the plenum 44 toward the manifold connection 30 a cavity 52 of the plenum 44 is created by the inner dividing wall 46 which has a cavity lowest point 54 defining a lowest elevation drain location of the cavity 52. To prevent fluid accumulation from being trapped in the cavity 52 at the cavity lowest point 54 which could displace as a single mass during a vehicle rapid acceleration event, an orifice 56 extending through the inner dividing wall 46 is positioned between the plenum 44 and the intake manifold runner 42 creating a passive drain path to drain a fluid such as water, oil and the like from the plenum 44 of the runner-plenum system 40.

A size of the orifice 56 is predetermined to meet two criteria. A first criteria is to passively drain the fluid in a drain flow direction 58 from the plenum 44 back into the intake manifold runner 42 without the orifice 56 becoming blocked by material or non-water liquid such as oil that can also be present in the cavity 52. A second criteria for sizing the orifice is that the orifice 56 does not adversely affect the primary function of the runner-plenum system 40 to deliver air and fuel without reducing an intake manifold air-fuel-ratio balance. By rolling the plenum 44 toward the manifold connection 30 as shown, a total runner-plenum width 60 measured from the manifold connection 30 to an outer end 62 of the plenum 44 is less for the runner-plenum system 40 than the total runner-plenum width 38 measured from the manifold connection 30 for the exemplary plenum 34 which is designed to maximize fluid drain. A package size for the intake manifold 10 can therefore be minimized while mitigating retention of fluid in the plenum 44 due to the cavity lowest point 54 created in the plenum 44 by rolling the plenum 44.

Figure 2:
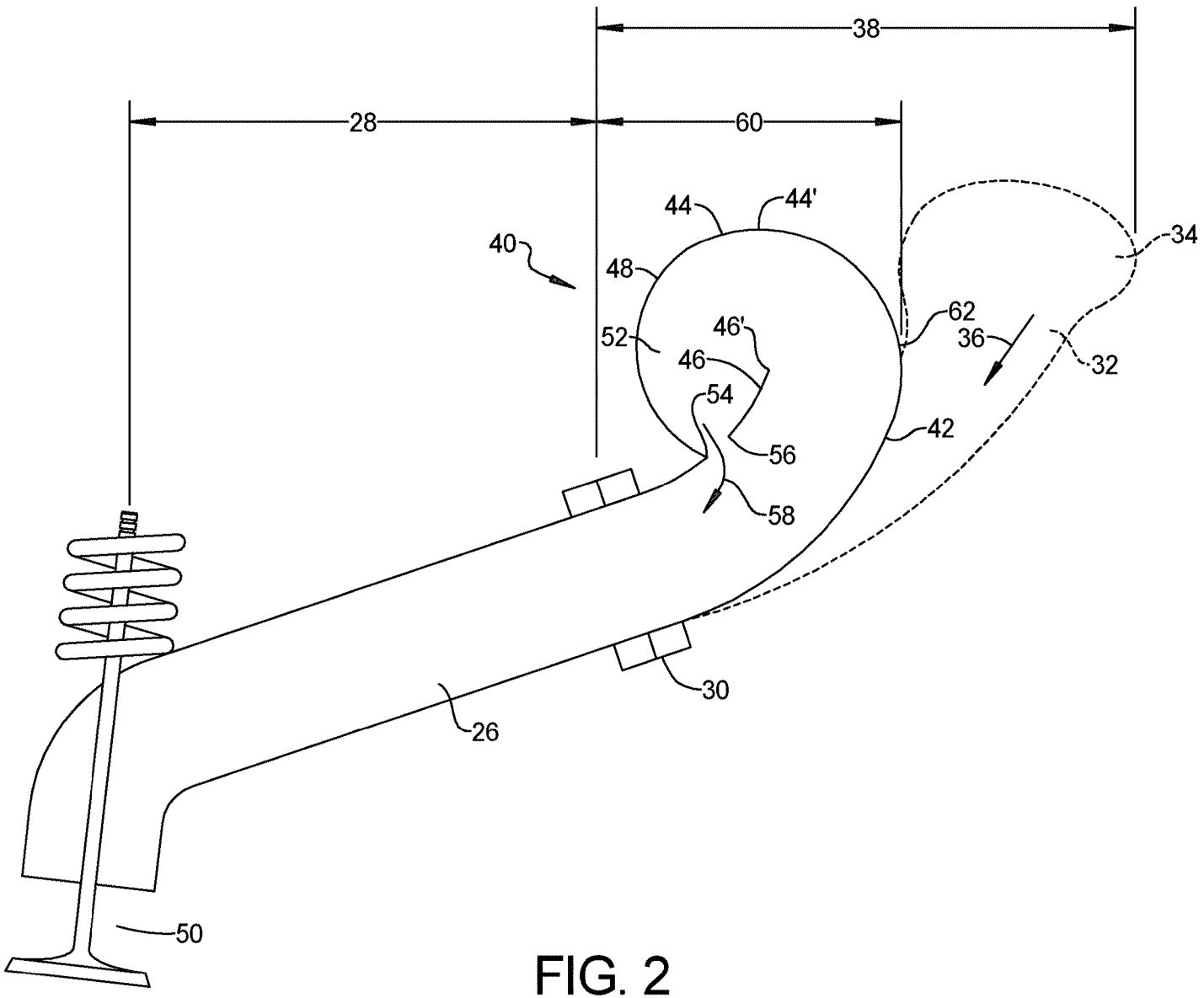
FIG. 2 is a cross-sectional front elevational view of a single runner of an intake manifold of the present disclosure.

Referring in general to FIGS. 3 through 8, it has been determined that preselecting a lateral location of the orifice 56 identified in FIG. 2 along the intake manifold runner 42 between the manifold connection 30 and the plenum 44 impacts a range of orifice sizes that may be used. Optimally, the orifice size (diameter) should be minimized to minimize impact on intake manifold air-fuel-ratio balance. Because the orifice 56 may be impacted by material that could block or partially block the orifice 56, a range of orifice sizes is also be available which provide adequate drain rates, minimize potential blockage, and minimize an impact to the intake manifold air-fuel-ratio balance. Different orifice locations for an exemplary intake runner length of 180 mm are presented. It should be noted that multiple different intake runner lengths may also be used within the scope of the present disclosure, and different positions of the orifice 56 are therefore also possible.

Referring specifically to FIG. 3 and again to FIG. 2, for a first analyses the orifice 56' was located in proximity to the cylinder head 50 defining a first end of the intake manifold runner 42' of a runner-plenum system 40'. A tubular passage for the orifice 56' is presented for clarity to show the drain path provided.

Figure 3:
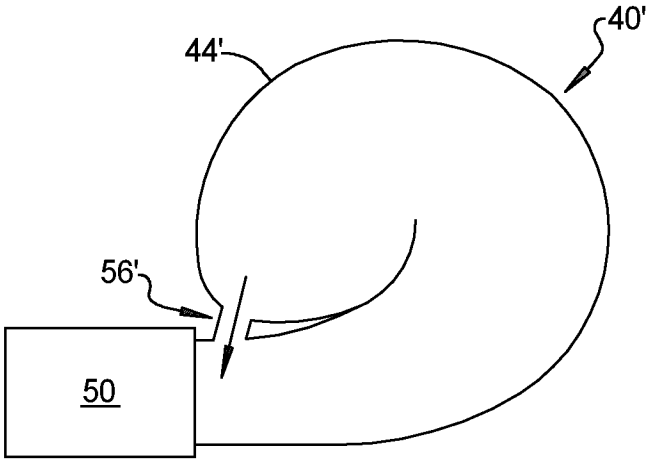
FIG. 3 is a cross-sectional front elevational view modified from FIG. 2 to show a first position of an orifice in the plenum-runner system.

Referring to FIG. 4 and again to FIG. 3, a graph 64 for the runner-plenum system 40' presents results of a flow analyses of different orifice sizes ranging from unmodified flow without an orifice (an orifice size of 0 mm) up to an orifice size of 10 mm ranging in 1 mm increments which was conducted. From graph 64 an orifice size ranging from zero up to 1 mm produced an acceptable range 66 of (less than 0.4) of operation. An orifice size ranging from 2 mm up to 7 mm produced a mid-range 68 (from 0.4 up to 1.0) which indicates additional operational testing may be required. An orifice size ranging from 8 mm up to 10 mm produced a result range 70 (greater than 1.0) deemed to be unacceptable with respect to intake manifold air-fuel-ratio balance.

Figure 4:
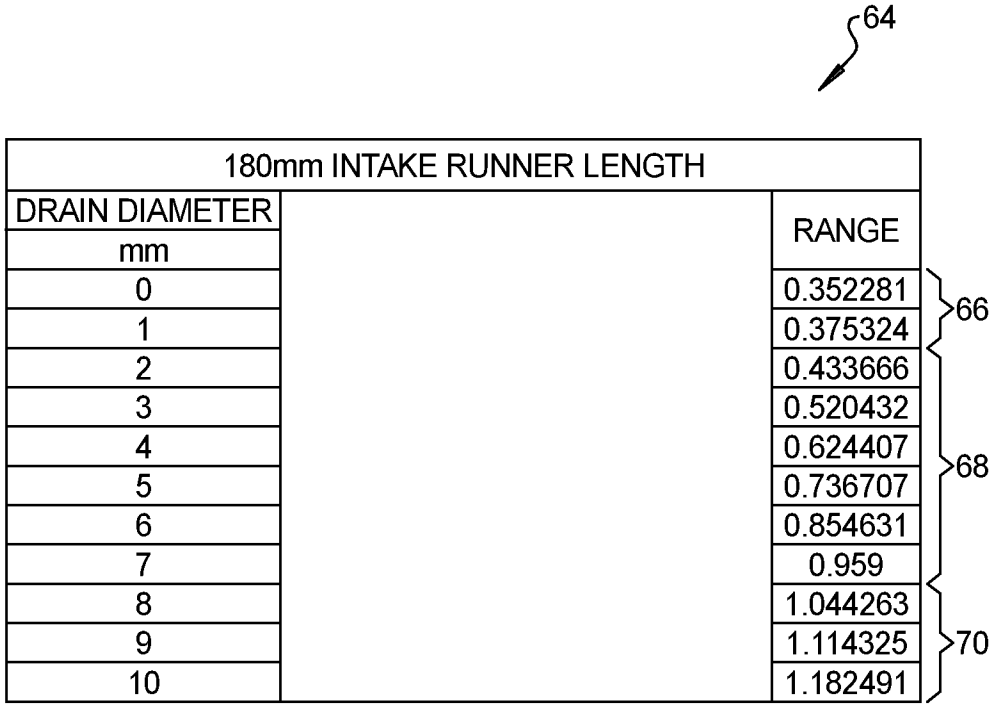
FIG. 4 is a graph presenting orifice size ranges for the configuration of FIG. 3.

Referring specifically to FIG. 5 and again to FIGS. 2 through 4, for another analyses the orifice 56" was located at a mid-point of the intake manifold runner 42" between the cylinder head 50 and the plenum 44" defining a runner-plenum system 40". As noted above, a tubular passage for the orifice 56" is presented for clarity.

Figures 5, 6:
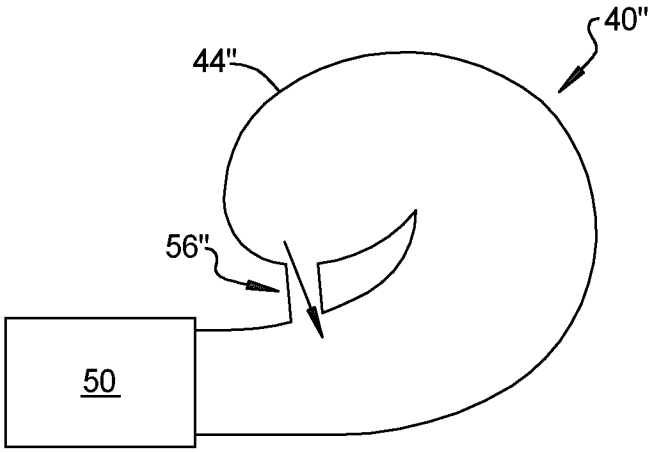
FIG. 5 is a cross-sectional front elevational view modified from FIG. 3 to show an intermediate position of an orifice in the plenum-runner system.
FIG. 6 is a graph presenting orifice size ranges for the configuration of FIG. 5.
Figure 8:
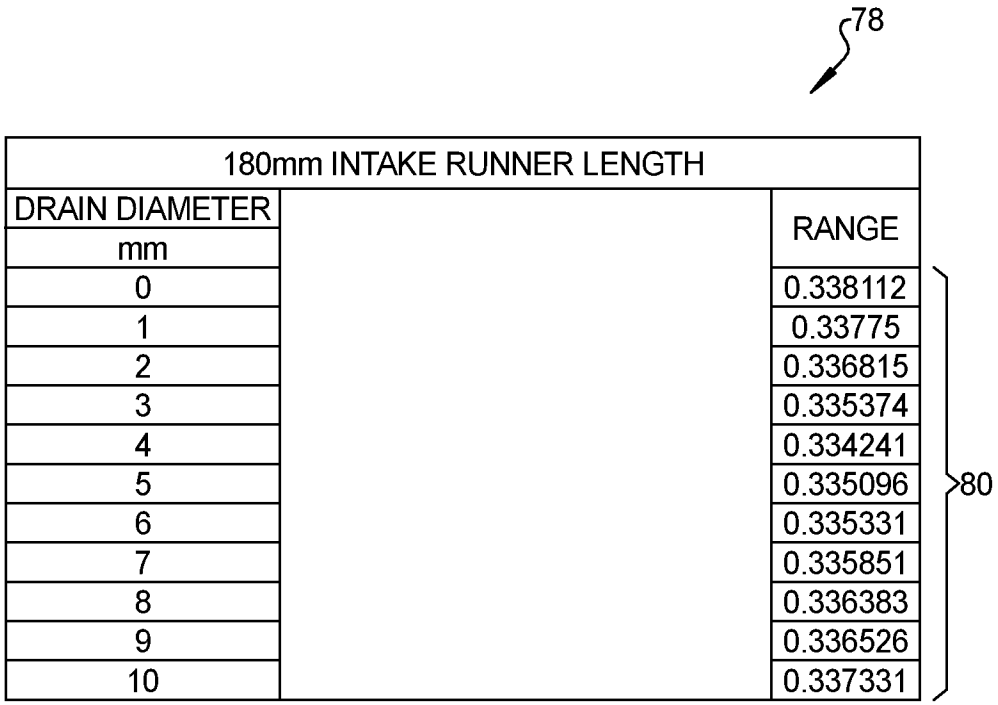
FIG. 8 is a graph presenting orifice size ranges for the configuration of FIG. 7.
Figure 7:
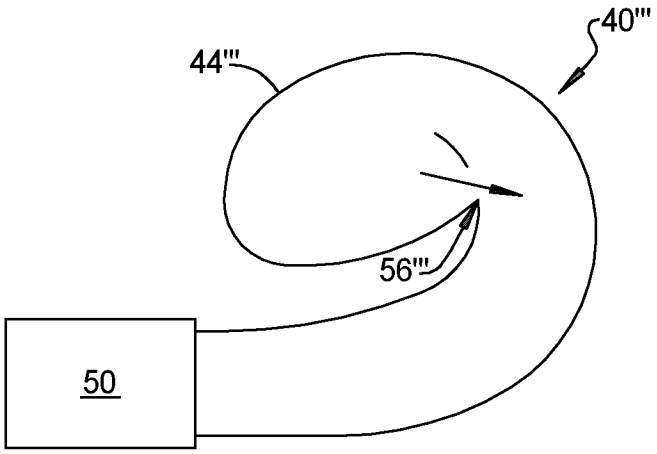
FIG. 7 is a cross-sectional front elevational view modified from FIGS. 3 and 5 to show an end position of an orifice in the plenum-runner system.

Referring to FIG. 6 and again to FIG. 5, a graph 72 for the runner-plenum system 40" presents results of a flow analyses of different orifice sizes ranging from unmodified flow without an orifice (an orifice size of 0 mm) up to an orifice size of 10 mm ranging in 1 mm increments. From graph 72 an orifice size ranging from zero (no orifice) up to 6 mm produced an acceptable range 74 (less than 0.4) of orifice operation. An orifice size ranging from 7 mm up to 10 mm produced a mid-range 76 (from 0.4 up to 1.0) which indicate additional operational testing may be required to confirm intake manifold air-fuel-ratio balance is maintained. For the runner-plenum system 40" having the orifice 56" located at a mid-point between the cylinder head 50 and the plenum 44" no orifice size up to and including 10 mm was found to be unacceptable with respect to intake manifold air-fuel-ratio balance.

Referring to FIG. 7 and again to FIGS. 3 through 6, in a further analyses the orifice 56'" was located in proximity to a start of the intake manifold runner 42'" and furthest of the three orifice locations from the cylinder head 50, defining a runner-plenum system 40". As discussed above, a tubular passage for the orifice 56'" is presented for clarity.

Referring to FIG. 8 and again to FIGS. 2 through 7, a graph 78 for the runner-plenum system 40'" presents results of a flow analyses of different orifice sizes ranging from unmodified flow without an orifice (an orifice size of 0 mm) up to an orifice size of 10 mm ranging in 1 mm increments. From graph 78 all orifice sizes ranging from zero (no orifice) up to 10 mm produced an acceptable range 80 of (less than 0.4) of operation when the orifice is located in proximity to the start of the intake manifold runner 42".

From FIGS. 3 through 8, using an exemplary runner length of 180 mm an optimum position for the orifice 56 positioned approximately at a mid-point of the intake manifold runner 42 between the cylinder head 50 and the plenum 44 provides the greatest range of acceptable orifice sizes that can be selected. As the orifice 56 is moved either closer to the cylinder head 50 or closer to the plenum 44 a range of acceptable orifice sizes is available, however the range of orifice sizes is more limited and a size of the orifice 56 may be limited to approximately 1 mm or less.

An intake manifold of an automobile vehicle of the present disclosure offers several advantages. These include provision of predetermined sized and located drains that do not adversely affect the performance requirements of an air delivery manifold. The drains in the form of an orifice provide a passive drain path for fluid from a plenum to drain a runner in the intake manifold.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An intake manifold of an automobile vehicle, comprising:

a manifold body connected to a cylinder head;

a runner within the manifold body in communication with the cylinder head;

a plenum within the manifold body in communication with the runner;

an orifice opening the plenum to the runner, the orifice defining a drain path to drain a fluid in the plenum to the runner;

an inner dividing wall positioned between and partially separating the runner and the plenum while allowing communication between the plenum and the runner over the inner dividing wall;

the plenum being rolled having a first wall of the plenum positioned on a side of the inner dividing wall facing a cylinder head; and a lowest point of the plenum located on the side of the inner dividing wall facing the cylinder head.

2. The intake manifold of the automobile vehicle of claim 1, wherein the orifice is created in the inner dividing wall.

3. The intake manifold of the automobile vehicle of claim 1, further including a cylinder head intake port having a fixed port length from a cylinder intake port to a manifold connection, the runner connected to the manifold connection with the runner in communication with the cylinder head intake port.

4. The intake manifold of the automobile vehicle of claim 3, wherein the orifice is positioned at a first end of the runner at the manifold connection.

5. The intake manifold of the automobile vehicle of claim 4, wherein a diameter of the orifice is in a range up to approximately 1 mm.

6. The intake manifold of the automobile vehicle of claim 3, wherein the orifice is positioned at a mid-point of the runner between the manifold connection and the plenum.

7. The intake manifold of the automobile vehicle of claim 6, wherein a diameter of the orifice is in a range up to approximately 6 mm.

8. The intake manifold of the automobile vehicle of claim 1, wherein the orifice is positioned at an end of the runner at the plenum and wherein a diameter of the orifice is in a range up to approximately 10 mm.

9. An intake manifold of an automobile vehicle, comprising:

a manifold body connected to a cylinder head;

a runner in communication with the cylinder head;

a plenum in communication with the runner;

an inner dividing wall positioned between and partially separating the runner and the plenum while allowing communication between the plenum and the runner over a dividing wall end of the inner dividing wall; and an orifice opening extending through the inner dividing wall providing a drain path from the plenum to the runner, the orifice draining a fluid collecting in the plenum to the runner, the orifice positioned at a lowest point of a cavity defined by the plenum between the inner dividing wall and a wall of the plenum positioned closer to the cylinder head than the inner dividing wall.

10. The intake manifold of the automobile vehicle of claim 9, wherein the orifice is further located at the lowest point of the cavity of the plenum.

11. The intake manifold of the automobile vehicle of claim 9, further including a manifold connection connecting the manifold body to the cylinder head, wherein the manifold connection is connected to a cylinder head intake port having a fixed port length from a cylinder intake port to the manifold connection.

12. The intake manifold of the automobile vehicle of claim 11, wherein the runner is connected to the manifold connection with the runner in communication with the cylinder head intake port with a gravity drain path provided from the orifice through the runner and into the cylinder head intake port.

13. The intake manifold of the automobile vehicle of claim 9, wherein an optimum location of the orifice ranges from a position at a beginning end of the runner proximate to the plenum to a position at a center of the runner between the manifold connection and the plenum.

14. The intake manifold of the automobile vehicle of claim 13, wherein at the location of the orifice at the beginning end of the runner proximate to the plenum a size of the orifice is in a range from zero mm up to approximately 10 mm, and at the location at the center of the runner between the manifold connection and the plenum the size of the orifice is in a range up to approximately 6 mm.

15. An intake manifold of an automobile vehicle, comprising:

a manifold body connected to a cylinder head;

a runner defining a passageway in communication with the cylinder head, the passageway downwardly sloping from an entrance of the runner toward a manifold connection coupling the runner to the cylinder head;

a plenum in communication with the runner, the plenum having a cavity with a cavity lowest point;

an inner dividing wall positioned between and partially separating the runner and the plenum while allowing communication between the plenum and the runner over a dividing wall end of the inner dividing wall;

an orifice extending through the inner dividing wall at the lowest point of the cavity defining a passive drain path from the plenum to the runner, the orifice draining a fluid collecting in the plenum to the runner, wherein:

the plenum is rolled having a first wall of the plenum positioned on a side of the inner dividing wall facing the cylinder head; and the lowest point of the plenum is located on the side of the inner dividing wall facing the cylinder head.

16. The intake manifold of the automobile vehicle of claim 15, wherein an optimum location of the orifice is preselected and located from a mid-point of the runner between the manifold connection and the plenum laterally to an end of the runner located at the plenum.

* * * * *